United States Patent [19]

Böehmer

[11] 4,044,883

[45] Aug. 30, 1977

[54] APPARATUS FOR ADVANCING A RIBBON IN OFFICE TYPEWRITERS, TELEPRINTERS, DATA PRINTERS AND THE LIKE

[75] Inventor: Georg Böehmer, Munich, Germany

[73] Assignee: Siemens Aktiengesellschaft, Berlin & Munich, Germany

[21] Appl. No.: 607,192

[22] Filed: Aug. 25, 1975

[30] Foreign Application Priority Data

Aug. 30, 1974 Germany ..... 2441694

[51] Int. Cl.[2] ..... B41J 33/32

[52] U.S. Cl. ..... 197/151; 197/55

[58] Field of Search ..... 197/151, 62, 68, 49, 197/53, 55; 74/242.8, 242.11 R

[56] References Cited

U.S. PATENT DOCUMENTS

| | | | |
|---|---|---|---|
| 2,069,595 | 2/1937 | Thomas | 74/242.8 |
| 2,831,424 | 4/1958 | MacDonald | 197/49 |
| 2,880,445 | 4/1959 | Wallis | 74/242.8 |
| 3,120,177 | 2/1964 | Clark | 197/151 |
| 3,283,876 | 11/1966 | Kern | 197/151 |
| 3,289,805 | 12/1966 | Kleinschmidt et al. | 197/18 |
| 3,349,887 | 10/1967 | Goff | 197/151 |
| 3,532,204 | 10/1970 | Sasaki | 197/151 |
| 3,841,459 | 10/1974 | Buschmann et al. | 197/151 |

OTHER PUBLICATIONS

Cross, Ribbon Drive, IBM Technical Disclosure Bulletin, vol. 15, No. 7, 12/72, p. 2312.

*Primary Examiner*—Ernest T. Wright, Jr.
*Assistant Examiner*—William Pieprz
*Attorney, Agent, or Firm*—Hill, Gross, Simpson, Van Santen, Steadman, Chiara & Simpson

[57] ABSTRACT

Apparatus for advancing the ribbon in printing machines such as office typewriters, teleprinters and the like, such apparatus including a pair of ribbon reels mounted on a type carrier carriage which is movable relative to a paper carriage, and a cable looped around a pair of drive rollers connected respectively to the ribbon reels for joint rotation. One end of the cable is held fast in relation to the paper carriage while the other end is connected to a selectively movable armature of an electro-magnet for alternately tensioning and relaxing the cable, whereby the ribbon reels are rotated by the cable as the type carrier carriage moves in an operative or printing direction relative to the paper carriage, but are not rotated as the type carrier carriage moves back in an operative direction to begin another printing cycle. A pair of cables and armatures may be used to effect reverse winding of the ribbon on the reels, and a single, double-acting armature may serve to tension and relax both cables.

9 Claims, 2 Drawing Figures

APPARATUS FOR ADVANCING A RIBBON IN OFFICE TYPEWRITERS, TELEPRINTERS, DATA PRINTERS AND THE LIKE

BACKGROUND OF THE INVENTION

This invention relates generally to the field of printing machines such as office typewriters, teleprinters, data printers and the like which utilize a ribbon for imprinting characters, and more particularly to an improved mechanism for advancing the ribbon after each character print-out.

For the satisfactory operation of printing machines which utilize a ribbon for effecting character print-out, it is desirable that the ribbon should be advanced by a predetermined amount after each individual character print-out. When ribbons of finite length are used, it is also necessary, in the economical use of such ribbons, to reverse the direction of movement of the ribbon after each full printing cycle, in order to automatically produce a number of ribbon cycles. Methods of and means for obtaining such reversal from switching criteria such as, for example, ribbon tension, have been heretofore known.

In printing devices in which the paper carriage is stationary in the direction of the printed row of characters and the type carrier carriage is moved along the row, it is known to arrange the ribbon supply and feeding mechanism on the moving type carrier carriage. The drive movement for the ribbon can be transferred to the moving type carrier carriage by a motor similarly arranged on the type carrier carriage or by drive means which are located in the stationary part of the machine, via gear elements. Drive motors arranged on the moving type carrier carriage load the latter to a considerable extent due to an increased moment of inertia and thus impede the high acceleration and speed of movement which is required, particularly in respect of the return movement of the carriage to the starting position at the beginning of the next row of characters to be printed.

If the drive motion for the ribbon is transferred to the movable type carrier carriage from a drive mechanism located on the stationary part of the printing machine through various gear elements it is desirable for the drive connection to be maintained only during the printing operation as the type carrier carriage moves in one direction, but not as the carriage is being returned to the beginning of the next row. While there exist various mechanisms for performing this function, such mechanisms are generally quite expensive.

On the other hand, arrangements have been previously disclosed whereby the movement for the ribbon is derived from the printing movement of the type carrier carriage, but in such situations the non-uniform loading by the ribbon drive can often impair the quality of printing.

An object of the present invention is to provide apparatus for advancing a ribbon whose supply mechanism is located on a type carrier carriage which moves along the printing row, which apparatus produces an acceptable load level on the type carrier carriage, and can be selectively operated by drive means disposed on the stationary part of the printing machine.

Apparatus satisfying these objects and constructed in accordance with the principles of the present invention may be characterized as comprising a cable mounted on the stationary part of the printing machine and looped around a drive roller connected for joint rotation to a ribbon reel mounted on the movable type carrier carriage. The cable may be selectively tensioned and relaxed to either rotate the ribbon reel as the type carrier carriage moves in relation to the stationary part of the printing machine, or to be ineffective with respect to the ribbon reel. In printing machines in which the direction of movement of the ribbon is reversed to accommodate plural ribbon printing cycles, two ribbon reels may be utilized, each having a corresponding drive roller about which the cable is looped.

Thus, for example, in accordance with the principles of the present invention, in printing machines in which the type carrier carriage moves relative to the paper carriage along the row of printed characters, the drive roller around which the cable is looped moves with the type carrier carriage. If the cable is relaxed, then slippage occurs between the cable and the drive roller, and the ribbon reel is therefore not drivingly connected to the cable. On the other hand, when the cable is subjected to a state of tension, such that it is tightly wrapped around the drive roller, the ribbon reel is rotated by the cable as the type carrier carriage moves.

In the circumstances, by utilizing control elements located in the stationary part of the printing machine, the cable tension can be relaxed during the movement of the type carrier carriage to a return or row starting position, thus eliminating the drive movement to the ribbon reel. When a ribbon of finite length is used the two ribbon reels around which the ribbon is wound may be driven by different cables, which may be respectively alternately subjected to a condition of tension and a relaxed condition to thereby reverse the direction of movement of the ribbon. The corresponding control criterion for reversing the direction of movement of the ribbon may involve the tension of the ribbon on the type carrier carriage and can be transmitted in previously known arrangements by means of suitable electric circuitry to a control mechanism located on the stationary portion of the printing machine.

Preferably the diameter of the drive roller which rotates the ribbon reel is approximately three times the core diameter of the ribbon reel. Thus, assuming a character feed step of one-tenth inch the ribbon is in each case advanced by at least the amount of the character line thickness of approximately 0.8 mm per character print-out.

In one embodiment of the invention the cable is selectively tensioned by means of a spring element, and is returned to a relaxed condition by means of adjustable control elements which effectively counteract the biasing force of the spring element. Thus as the type carrier carriage is disposed in a starting position at the beginning of a row of characters to be printed, the cable, under the influence of the bias of the spring element, firmly grips the drive rollers to rotate the ribbon reels as the type carrier carriage moves across the row. On the other hand, after the completion of a row of printed characters, and as the type carrier carriage is moving back to a starting position to commence the printing of the next row, the biasing effect of the spring element is eliminated, resulting in a slackening of the cable loop around the drive rollers whereby the ribbon reels are not subjected to a turning force. Suitable means such as an electro-magnet may be utilized to counteract or offset the biasing effect of the spring element as the type carrier carriage is returned to a starting position.

If a ribbon of finite length is wound back and forth between two ribbon reels, a common electro-magnet may be utilized in association with a spring element which, by virtue of a single two-armed pivot lever, selectively maintains one of a pair of cables relaxed and the other in a condition of tension. The pivot lever for the two cables can conveniently comprise a two-armed hinged armature of an electro-magnet. In this arrangement, as electro-magnet is de-energized during the return movement of the type carrier carriage, one of the two cables is relieved while the second cable is subjected to spring tension. Since the return movement of the type carrier carriage itself counteracts the spring force, the cable which is tensioned by the spring force is also somewhat slackened such that the drive connection between the cables and the ribbon reels are eliminated. Thus the ribbon remains stationary with respect to the ribbon reels and the type carrier carriage as the carriage returns to its starting position upon completion of a printing cycle.

While the return movement of the type carrier carriage may be sufficient in and of itself to satisfactorily overcome or counteract the bias of the spring element during a return movement of the carriage, any tendency which the cables may have to move the ribbon may be eliminated by utilizing idler mechanisms between the ribbon reels and the drive rollers about which the cables are looped.

By increasing the number of loop windings of the cable around the drive rollers the tension forces transferred to the rollers may be increased. Further, the degree of adhesion or friction between the drive rollers and the cables can be influenced by a suitable selection of the materials employed. In a preferred embodiment the cable is made of steel and the drive rollers are provided with steel treads.

Many other features, advantages and additional objects of the present invention will become manifest to those versed in the art upon making reference to the detailed description which follows and the accompanying sheets of drawings, in which preferred structural embodiments incorporating the principles of the present invention are shown by way of illustrative example only.

DESCRIPTION OF THE PREFERRED EMBODIMENTS

Figure 1:
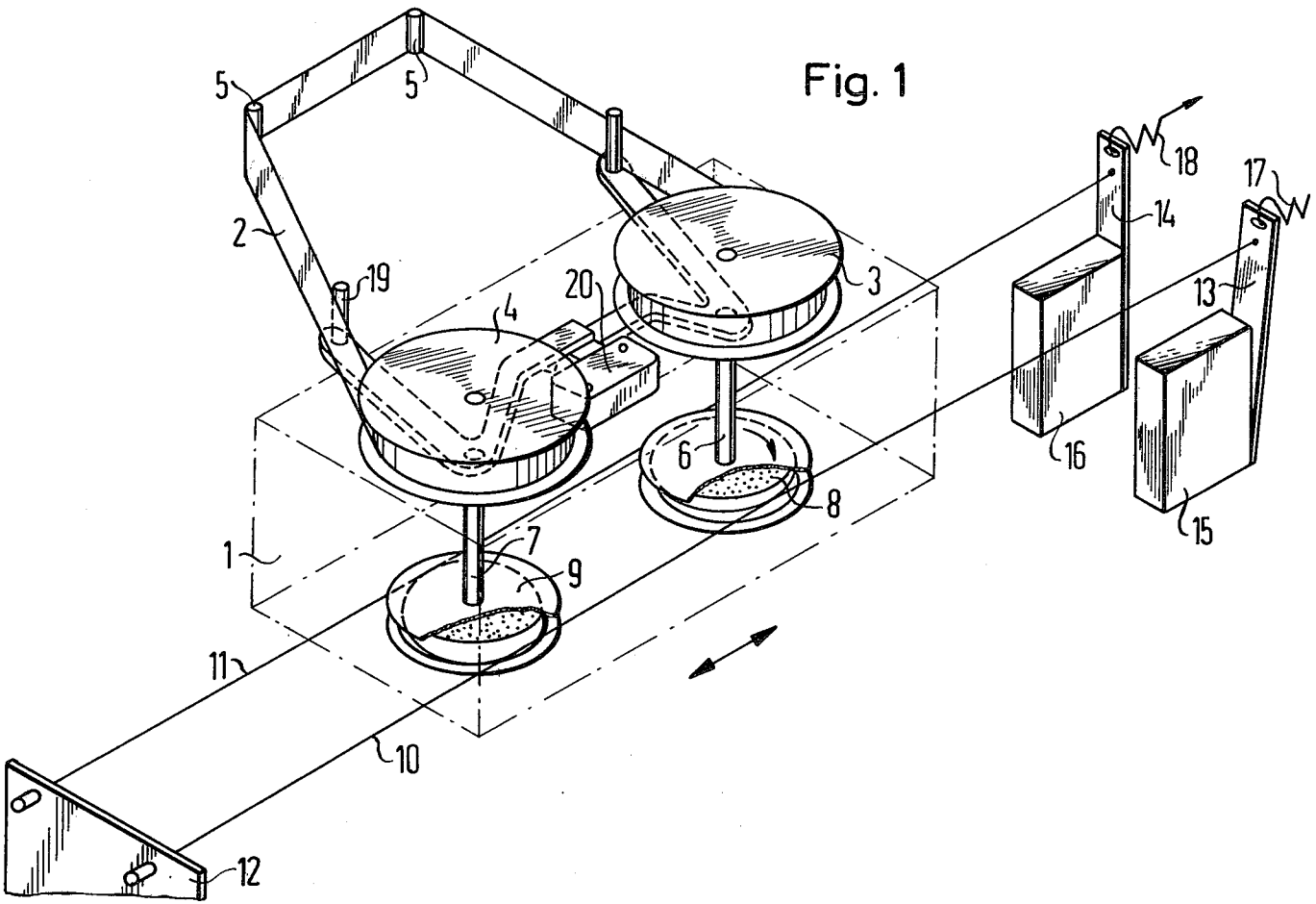
FIG. 1 is a perspective, somewhat schematic view, of apparatus for advancing the ribbon in a printing machine constructed in accordance with the principles of the present invention.

Referring to FIG. 1, a type carrier carriage of a printing machine such as an office typewriter, teleprinter, data printer or the like is indicated generally at reference numeral 1 and is movable in the directions of the double arrow along the printing row of a suitable page-printer data carrier mounted on the printing machine. A ribbon assembly comprising a ribbon 2 moves across a printing position as it winds between two ribbon reels 3 and 4, guided by a pair of guide pins 5, 5. The ribbon reels 3 and 4 are rotatably mounted on the type carrier carriage 1 by virtue of shafts 6 and 7 and each comprises a core around which the ribbon 2 is wound.

A pair of drive rollers 8 and 9 are secured respectively on the shafts 6 and 7. Looped around the drive rollers 8 and 9 are a pair of cables 10 and 11 which extend along the direction of movement of the type carrier carriage. One end of each of the cables 10 and 11 is fixedly connected to a stationary bar 12 which may be mounted in fixed assembly to the printing machine. The other ends of the cables 10 and 11 are connected respectively to a pair of hinged armatures 13 and 14 of a pair of electro-magnets 15 and 16. A pair of spring members 17 and 18 normally bias the armatures 13 and 14 to subject the cables 10 and 11 to a condition of tension such that the cables firmly embrace their corresponding drive rollers 8 and 9. When the electro-magnets 15 and 16 are energized, however, the hinged armatures 13 and 14 are subjected to a force which counteracts and overcomes the biasing effect of the springs 17 and 18, whereby the cables 10 and 11 are relaxed and loosened around their corresponding drive rollers 8 and 9.

During the advance of the type carrier carriage 1 in a printing or line-typing direction along the row of characters being printed, one of the two electro-magnets, such as electro-magnet 16, is energized, whereby its hinged armature 14 is pivoted against the force of the spring member 18, thus relaxing and slackening the cable 11. While the adhesion or frictional force between the cable 11 and its corresponding drive roller 9 is effectively eliminated, the adhesion or turning force between the cable 10 and the drive roller 8 is maintained, such that with each character advance of the type carrier carriage 1, the drive roller 8 effectively rolls or moves along the length of the cable 10 a corresponding distance. The ribbon 2 is thus wound onto the ribbon reel 3 and off of the ribbon reel 4.

When the ribbon reel 3 is full and the ribbon reel 4 is essentially empty, the operation of a tension sensing lever 19, as a result of increased ribbon tension, actuates a contact 20, by virtue of which the electro-magnet 16 is de-energized and the electro-magnet 15 is energized so that the cable 10 loosens and becomes slack on the drive roller 8 and the cable 11 is tightened about the drive roller 9, as a result of which the direction of movement of the ribbon 2 is reversed.

Figure 2:
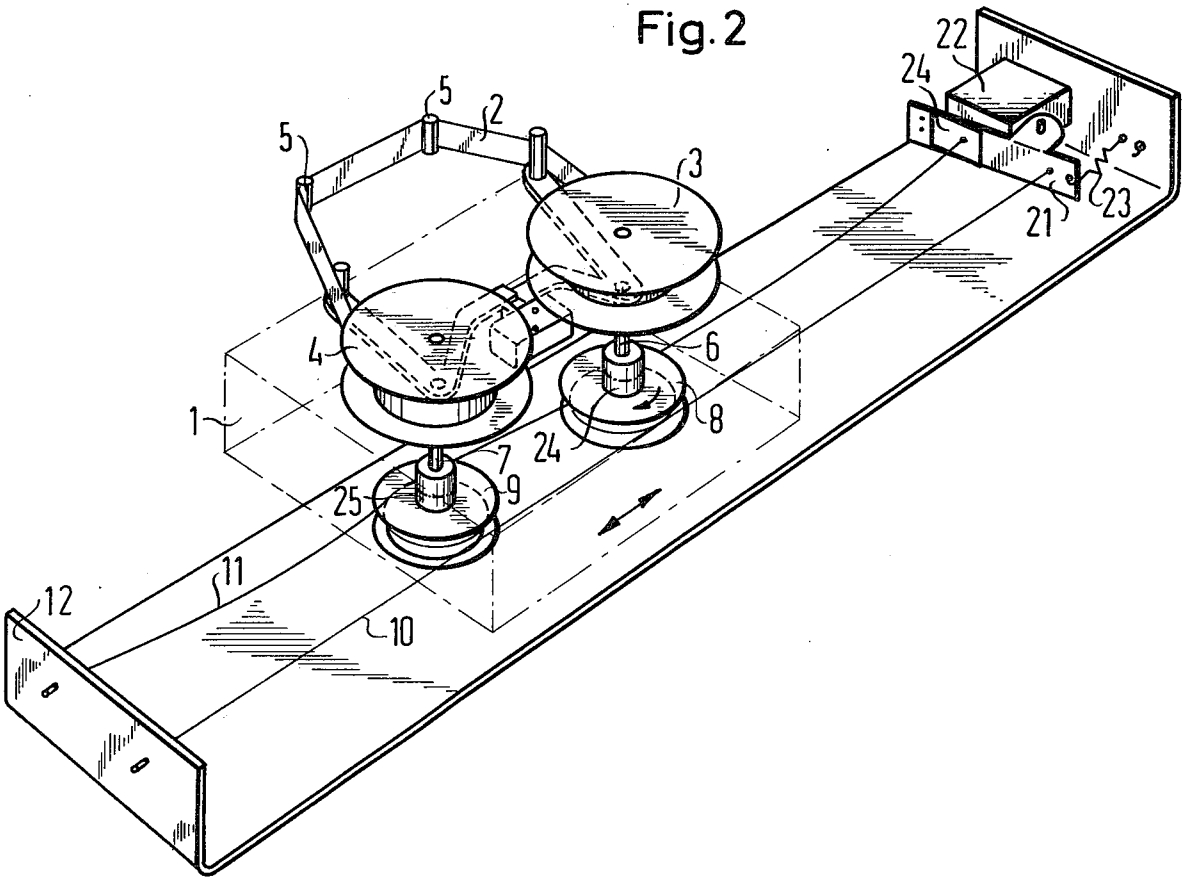
FIG. 2 is similar to FIG. 1 but discloses another embodiment of the invention.

In arrangements wherein at the conclusion of the printing operation in a row the type carrier carriage 1 is returned to a starting position, the two electro-magnets 15 and 16 are both energized so that no drive movements are transmitted from the slackened cables 10 and 11 to the two drive rollers 8 and 9. In the embodiment shown in FIG. 2, in which parts similar to those shown in FIG. 1 are indicated with similar reference characters, the two cables 10 and 11 are tightened and relaxed in alternately opposing relation by means of a single dual-armed hinged armature 21 of an electro-magnet 22. The tension force for the cable 10 is produced by an armature return spring 23, while the tension force for the cable 11 is established through the energizing force of the electro-magnet 22 by virtue of a spring member 24 mounted on the armature 21.

While the return movement of the type carrier carriage 1 may be generally sufficient to provide the necessary slackening effect of the cables 10 and 11 around the drive rollers 8 and 9, such slackening effect may be ensured, to avoid all driving motion from the drive rollers 8 and 9 to the ribbon 2, by virtue of idling mechanisms such as one way clutches or similar devices shown at 25 and 26 interposed on the shafts 6 and 7 between the drive rollers 8 and 9 and the ribbon reels 3 and 4. If the arrangement is such that during the return movement of the type carrier carriage 1 to its starting position, the armature 21 will always assume one of its two operating positions, only one idling mechanism 24 and 25 is necessary, as will be understood by those skilled in the art, the cable which loops over the drive roller connected to the remaining idler mechanism being maintained in an operative condition by virtue of the hinged armature 21.

As mentioned hereinabove, the diameter of the drive rollers 8 and 9 are preferably three times the core diameter of the ribbon reels 3 and 4.

Although minor modifications might be suggested by those versed in the art, it should be understood that I wish to embody within the scope of the patent warranted hereon all such modifications as reasonably come within the scope of my contribution to the art.

What I claim is:

1. A ribbon-type printing machine comprising a stationary member, a type carrier carriage mechanism, means for moving said type carrier carriage mechanism relative to said stationary member in a line-typing direction, and a ribbon advancing, mechanism comprising ribbon reel means including a ribbon reel for receiving ribbon windable thereabout upon rotation thereof, drive roller means including a drive roller for rotating said ribbon reel, means rotatably mounting said ribbon reel and said drive roller on said type carrier carriage mechanism for movement therewith in the line-typing direction, means interconnecting said drive roller and said ribbon reel for corotation, a cable fixed at one end to said stationary member extending substantially in parallel relation to said line-typing direction and in tangential relation to said drive roller except for a portion thereof looped around said drive roller for rotating same upon tensioning of said cable relative to said stationary member, and cable tensioning means attached to the other end of said cable for selectively tensioning said cable to rotate said drive roller and said ribbon reel whereby upon tensioning of said cable, the movement of said carriage mechanism relative to said stationary member serves to cause a rotation of said drive roller and a corresponding ribbon advancing movement.

2. A printing machine as defined in claim 1 in which said ribbon reel has a core the diameter of which is approximately 1/3 the diameter of said drive roller.

3. A printing machine as defined in claim 1 wherein said cable tensioning means comprises a spring member for biasing said cable means in one direction to tension said cable means and means for selectively overcoming the bias of said spring member to relax said cable means.

4. A printing machine as defined in claim 1 wherein said means interconnecting said drive roller and said ribbon reel comprises a one-way clutch.

5. A printing machine as defined in claim 1 including means forming a steel tread on said drive roller.

6. A printing machine as defined in claim 1 wherein said cable means comprises a pair of cable looped around said drive roller such that said drive roller is rotated in one direction of rotation as said type carrier carriage mechanism is moved in a line-typing direction upon tensioning of one of said cables, and is rotated in an opposite direction of rotation as said type carrier carriage mechanism is moved in a line-typing direction upon tensioning of the other of said cables.

7. A ribbon-type printing machine comprising a stationary member, a type carrier carriage mechanism, means for moving said type carrier carriage mechanism relative to said stationary member in a line-typing direction, and a ribbon advancing mechanism comprising ribbon reel means including a ribbon reel for receiving ribbon windable thereabout upon rotation thereof, drive roller means including a drive roller for rotating said ribbon reel, means rotatably mounting said ribbon reel and said drive roller on said type carrier carriage mechanism for movement therewith in the line-typing direction, means interconnecting said drive roller and said ribbon reel for corotation, cable means looped around said drive roller for rotating same upon tensioning of said cable means, cable holding means for connecting one end of said cable means to said stationary member, and cable tensioning means attached to the other end of said cable means for selectively tensioning said cable means to rotate said drive roller and said ribbon reel, said cable tensioning means comprising a spring member for biasing said cable means in one direction to tension said cable means and means for selectively overcoming the bias of said spring member to relax said cable means, said means for selectively overcoming the bias of said spring member comprising an electro-magnet.

8. A ribbon-type printing machine comprising a stationary member, a type carrier carriage mechanism, means for moving said type carrier carriage mechanism relative to said stationary member in a line-typing direction, and a ribbon advancing mechanism comprising ribbon reel means including a ribbon reel for receiving ribbon windable thereabout upon rotation thereof, drive roller means including a drive roller for rotating said ribbon reel, means rotatably mounting said ribbon reel and said drive roller on said type carrier carriage mechanism for movement therewith in the line-typing direction, means interconnecting said drive roller and said ribbon reel for corotation, cable means looped around said drive roller for rotating same upon tensioning of said cable means, cable holding means for connecting one end of said cable means to said stationary member, and cable tensioning means attached to the other end of said cable means for selectively tensioning said cable means to rotate said drive roller and said ribbon reel, said cable means comprising a pair of cables looped around said drive roller such that said drive roller is rotated in one direction of rotation as said type carrier carriage mechanism is moved in a line-typing direction upon tensioning of one of said cables, and is rotated in an opposite direction of rotation as said type carrier carriage mechanism is moved in a line-typing direction upon tensioning of the other of said cables, said cable tensioning means comprising a single two-armed pivot lever, a spring member for biasing said pivot lever in one direction to a first position and an electro-magnet for biasing said pivot lever in an opposite direction to a second position, whereby said cables are respectively alternately tensioned and relaxed as said pivot lever moves between said first and second positions.

9. A ribbon-type printing machine comprising a stationary member, a type carrier carriage mechanism, means for moving said type carrier carriage mechanism relative to said stationary member in a line-typing direction, and a ribbon advancing mechanism comprising ribbon reel means including a ribbon reel for receiving ribbon windable thereabout upon rotation thereof, drive roller means including a drive roller for rotating said ribbon reel, means rotatably mounting said ribbon reel and said drive roller on said type carrier mechanism for movement therewith in the line-typing direction, means interconnecting said drive roller and said ribbon reel for corotation, cable means looped around said drive roller for rotating same upon tensioning of said cable means, cable holding means for connecting one end of said cable means to said stationary member, and cable tensioning means attached to the other end of said cable means for selectively tensioning said cable means to rotate said drive roller and said ribbon reel, said cable means comprising a pair of cables looped around said drive roller such that said drive roller is rotated in one direction of rotation as said type carrier carriage mechanism is moved in a line-typing direction upon tensioning of one of said cables, and is rotated in an opposite direction of rotation as said type carrier carriage mechanism is moved in a line-typing direction upon tensioning of the other of said cables, said cable tensioning means comprising a single two-armed pivot lever, a spring member for biasing said pivot lever in one direction to a first position and an electro-magnet for biasing said pivot lever in an opposite direction to a second position, whereby said cables are respectively ultimately tensioned and relaxed as said pivot lever moves between said first and second positions, said pivot lever comprising an armature of said electro-magnet and said cables being respectively connected to said armature on the opposite sides of the axis of pivot thereof.

* * * * *